United States Patent [19]

Spalding et al.

[11] Patent Number: 4,992,770

[45] Date of Patent: Feb. 12, 1991

[54] FUSE WITH IMPROVED SPRING TIMER

[75] Inventors: Keith A. Spalding, Fenton; Fred Levko, Chesterfield; Donald Johnston, St. Louis, all of Mo.; John Ackermann, Belleville, Ill.; Arlie Ehlman, Barnhart, Mo.

[73] Assignee: Cooper Industries, Inc., Houston, Tex.

[21] Appl. No.: 405,336

[22] Filed: Sep. 11, 1989

[51] Int. Cl.[5] ..... H01H 85/04

[52] U.S. Cl. ..... 337/164; 337/166

[58] Field of Search ..... 337/163, 164, 165, 166

[56] References Cited

U.S. PATENT DOCUMENTS 3,342,964 9/1967 Kozacka ..... 337/164

4,344,058 8/1982 Knapp, Jr. et al. ..... 337/148

*Primary Examiner*—H. Broome

*Attorney, Agent, or Firm*—Donald J. Verplancken; David A. Rose; Ned L. Conley

[57] ABSTRACT

The dual element time delay fuse includes a circuit overload trigger which opens the fuse in response to long term medium circuit overloads, and a short circuit strip disposed in a solid matrix filler for opening the fuse in response to the presence of a short circuit in the circuit.

21 Claims, 2 Drawing Sheets

FUSE WITH IMPROVED SPRING TIMER

BACKGROUND OF THE INVENTION

This invention relates to the field of fuses, more particularly time delay dual element cartridge fuses capable of interrupting circuits under both overload and short circuit conditions.

Time delay fuses include a short circuit element projecting from a spring trigger mechanism to form a fusing assembly, which is then held in an insulated tube and mechanically and electrically connected to opposed end ferrules. A time delay low voltage cartridge fuse of this type is disclosed in U.S. Pat. No. 4,344,058, Knapp, Jr , et.al.

The short circuit element is anchored to the spring trigger mechanism through a spring loaded bullet member. The bullet member is a cold headed part and extends outward from a barrel having a spring therein to bias the bullet toward re-entry of the barrel. An open ended paper sleeve surrounds the barrel, and the open end of the barrel opposite the bullet is covered with a barrel plug which is received in an inner radial lip therein. The barrel also has an outer radial flange on its open end adjacent the inner radial lip. This flange is used to position the open ended paper sleeve thereon. The paper sleeve is assembled over the barrel and biased to abut the flange. The paper sleeve insulates the heater strip, which carries current from one end of the fuse, from contact with the barrel. Since the sleeve is assembled to abut against the outer radial flange, and the heater strip is soldered to the end of the bullet and extends over the paper sleeve, the paper sleeve must be assembled to the barrel before the heater strip is soldered to the bullet. The paper sleeve insulates the trigger barrel from the heater strip.

To help isolate the interior of the trigger mechanism, a barrel plug is located in the end of the barrel and an insulating washer is disposed over the barrel plug and end of the trigger. The barrel includes a circumferential ledge on its inner diameter adjacent its end into which the barrel plug is located. The barrel plug helps isolate the inside of the trigger from arc quenching fillers, such as sand, disposed within the fuse. The washer electrically insulates the barrel plug from the end ferrule. To mechanically and electrically link the heater strip, bullet and short circuit element, a fusing alloy is disposed at the juncture of the bullet and barrel, heater strip and short circuit element. The fusing alloy is a low melting point solder designed to melt when the heat given off by the heater strip from a long term overload condition elevates its temperature to the melting point. Upon assembly of this sub-assembly into the insulating tube, the heater strip is folded over the sides of the barrel, and a ferrule is fitted and heated over the end, creating an electrical path therebetween.

To quench any electrical arcing which arises after the fuse element melts, some prior art fuses are packed with arc quenching sand. The washer and barrel plug are used to prevent entry of sand into the trigger mechanism, and the bullet portion is tapered to allow a minimum space between it and the barrel when the fuse is in the closed position, which helps prevent jamming of the trigger with the filler as the trigger opens. The sand surrounds both the trigger and short circuit strip elements of the fuse.

In operation, the fuse will open under two types of conditions. If a short circuit is encountered, the heat produced in the short circuit element, which is caused by the passage of excess electric current through the necked down portions thereof, causes the short circuit element to melt, opening the circuit across the opposed end ferrules of the fuse. Under long term overload conditions, the electric current flowing through the heater strip generates heat, and after a sufficient period of time the heat will cause the fusing alloy to melt. This causes the spring to retract the bullet into the barrel, thus causing the bullet to pull away from the short circuit element, opening the circuit through the fuse.

In the prior art designs, the spring loaded trigger is a complex and a costly design The barrel is made on a screw machine, to include the inner radial lip to retain the plug and an outer flange to locate the paper sleeve. The fuse plug and paper sleeve must be separately located onto the barrel, and the washer must be placed over the trigger, before the ferrule is loaded over the end of the tube.

SUMMARY OF THE INVENTION

The improved fuse includes a trigger having a barrel for receiving a spring loaded bullet therein, an insulated end cap having an integral end, or cover, disposed over the barrel to cover the circumferential outer surface and open end of the barrel opposite the bullet, and a silver short circuit strip disposed in a solid matrix arc quenching filler. A heater strip is disposed over the outer circumferential surface of the end cap which is then disposed in one end of an insulated tube. The heater strip includes ears which help center the trigger in the fuse tube. The short circuit strip, which is electrically and mechanically linked to a ferrule on the opposite end of the tube, engages the bullet and heater strip in a solder coating, or fusing alloy.

By employing a sleeve having an integral end cap, the barrel plug and washer are eliminated, thereby reducing the number of parts in the assembly. Further, by eliminating the barrel plug, the need for the plug lip in the barrel is eliminated. Further, the outer flange at the end of the barrel is eliminated. This permits manufacture of the trigger through relatively inexpensive stamping as opposed to screw machine turning.

The elimination of the flange on the end of the barrel also allows for assembly of the paper sleeve after the solder juncture between the trigger and the short circuit and heater strip is made. This results in easier soldering of these elements, with resultant reduced labor and fixuring costs, because the risk of burning the sleeve is eliminated. As a result, the assembly of the fuse is easily semi-automated.

The spring ears permit the easy centering of the trigger in the tube, and the ears help maintain the trigger longitudinally in the tube during final assembly.

The use of a solid matrix filler adjacent the short circuit strip helps dissipate the energy of the arc occurring during short circuit fuse interruptions.

BRIEF DESCRIPTION OF THE DRAWINGS

The above and other objects and advantages of the invention will become apparent from the accompanying description when read in conjunction with the following drawings wherein.

BRIEF DESCRIPTION OF THE PREFERRED EMBODIMENT

Figure 1:
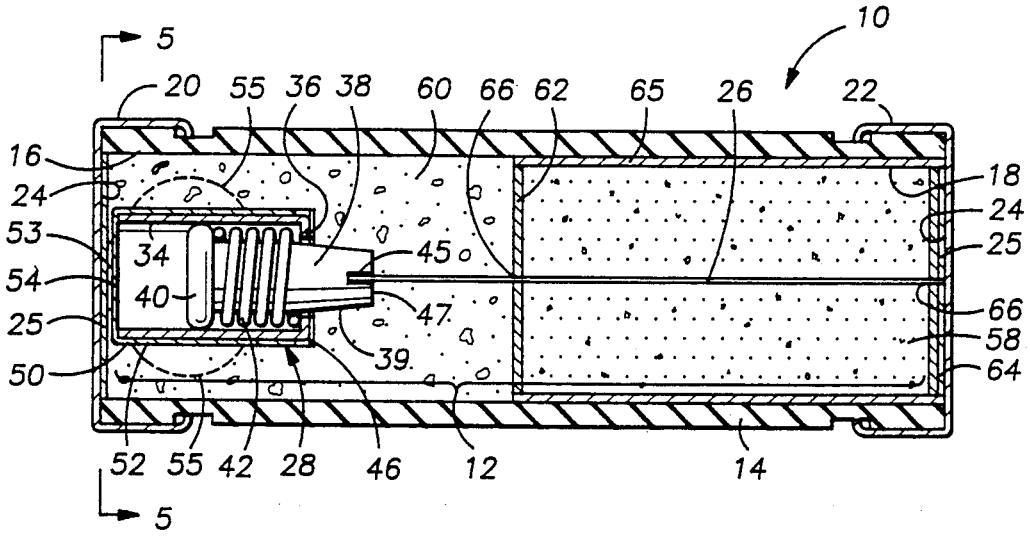
FIG. 1 is a cross-sectional view of a fuse in the unopened condition having the improved trigger of the present invention.
Figure 2:
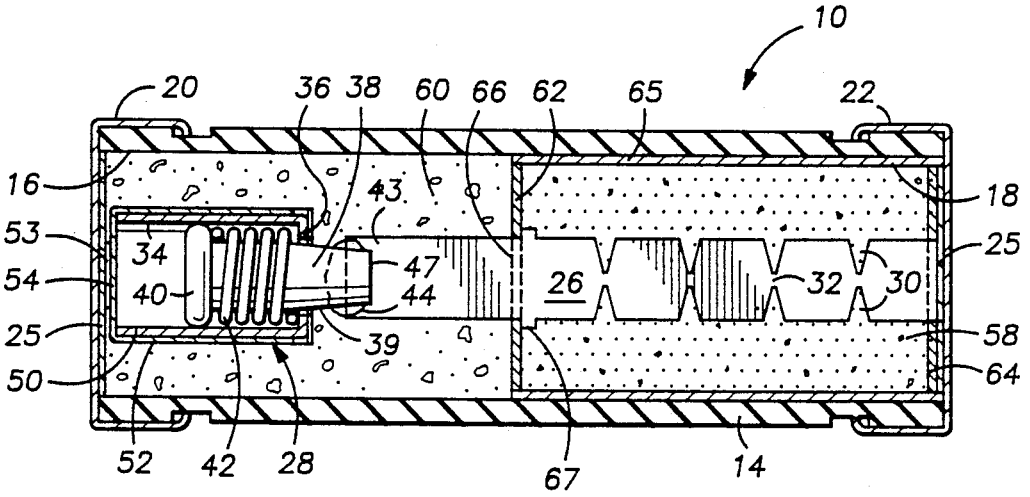
FIG. 2 is a second cross-sectional view of the fuse of FIG. 1 in the unopen condition rotated 90 degrees.
Figure 3:
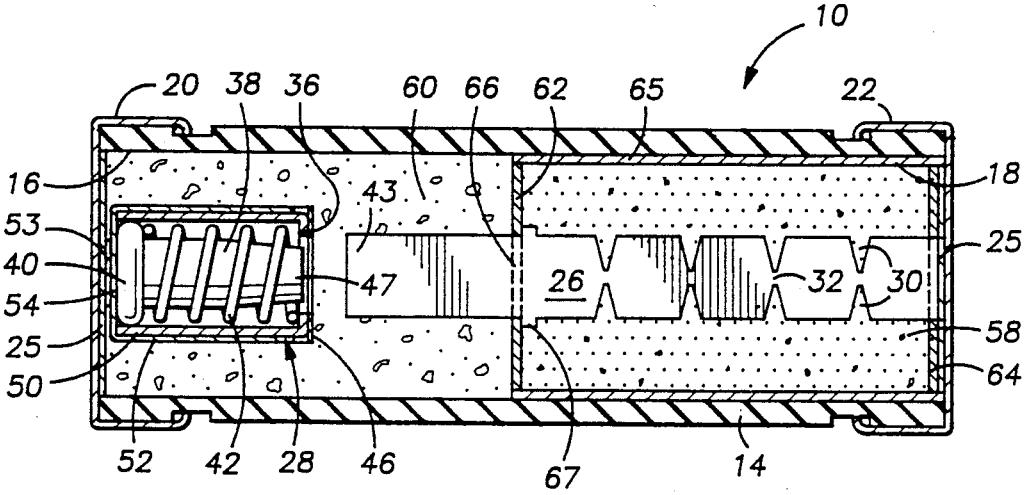
FIG. 3 is a cross-sectional view of the fuse of FIG. 1 following a long term circuit overload, triggering the spring trigger to open the fuse.
Figure 4:
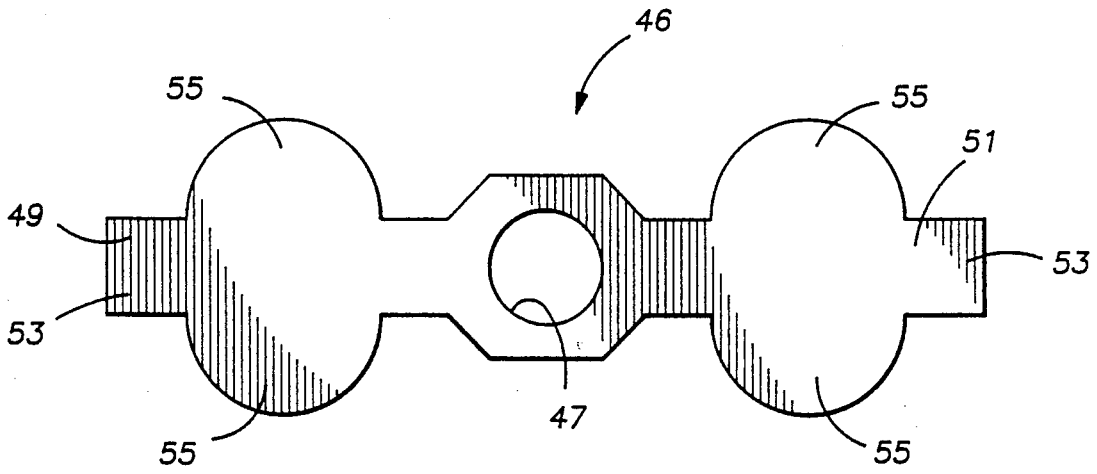
FIG. 4 is a plan view of the heater strip prior to assembly thereof on the trigger of the fuse of FIG. 1.
Figure 5:
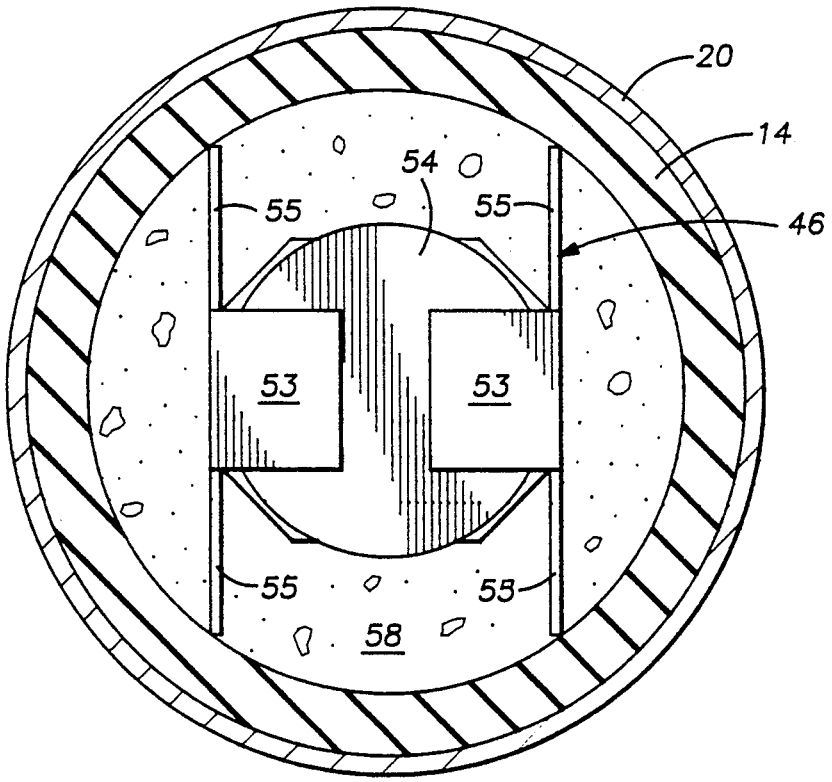
FIG. 5 is a cross-sectional view of the fuse of FIG. 1 at 5—5.

Referring to FIGS. 1 to 3, fuse 10 includes a fusing subassembly 12 disposed within insulative tube 14. Insulative tube 14 has opposed open ends 16 and 18 having opposed ferrules 20 and 22 thereon. Ferrules 20 and 22 are coated on their interior flat end surface 24 with a solder coating 25 and crimped and heated onto insulative tube 14 upon final assembly of the fuse 10.

Fusing assembly 12 includes a short circuit strip 26 and a spring loaded trigger 28 disposed in series within tube 14. Short circuit strip 26 is preferably manufactured from a silver material, but fusing materials such as silver or copper or alloys of each may also be used. A series of cutouts 30 are punched through the fusing material, leaving a series of narrow current strips 32 for carrying electric current therethrough. Short circuit strip 26 is sized to carry currents of five to eight times the fuse's rated current without difficulty, but will melt almost instantaneously with the application of high current resulting from a short circuit.

Trigger assembly 28 is likewise mounted in tube 14, and includes a metallic barrel 34 having a flange 36 thereon. Barrel 34 is preferably manufactured from 360 Brass. A matallic bullet 38 extends outward from barrel 34, and has a spring retainer lip 40 projecting radially outward at the end thereof received within barrel 34. A spring 42 is disposed against and between spring retainer lip 40 and flange 36. Bullet 38 extends outward from flange 36 and is connected to lead 43 of short circuit strip 26 with fusing alloy 44. To help position lead 43 with respect to bullet 38, an alignment slot 45 is disposed in the end 47 of bullet 38 and lead 43 is received therein. Bullet 38 has a tapered outer surface 39, such that its diameter adjacent the spring retainer lip 40 is greater than its diameter adjacent the barrel flange 36. Therefore, in the fully extended bullet 38 position shown in FIG. 1, the space between the side of the bullet 38 and the flange 36 is minimized. Bullet 38 and lead 43 are bonded together with fusing alloy 44, which juncture provides a force to maintain bullet 38 in position to compress spring 42. To further help maintain spring 42 in compression between flange 36 and lip 40, a bead of fusing alloy 44 is placed circumferentially about the flange 36-bullet 38 interface with the lip 40 of bullet 38 fully compressing spring 42 against flange 36. When fuse 10 opens, as shown in FIG. 3, fusing alloy 44 melts and the taper of the bullet 38 helps assure that barrel 34 and bullet 38 do not interfere, which would prevent opening of the fuse trigger. Fusing alloy 44 is a lead-tin-bismuth solder having a low melting point which will melt when a long term overload condition exists.

Referring to FIGS. 1 through 4, spring trigger assembly 28 further includes heater strip 46, which is bent over a paper cap 50 adjacent ferrule 20. Heater strip 46 is a strip of resistance metal, preferably a copper alloy, which generates heat when an electrical current is passed therethrough. The cross section of heater strip 46 is sized to generate little heat during normal conditions, i.e. the passage of rated fuse current, but will generate substantial heat when exposed to 135% to 500% of rated current. Heater strip 46 includes bullet retainer 47, which is a circular cutout through the center thereof, and a pair of opposed flaps 49 and 51 radiating outward therefrom. Each flap 49 and 51 includes a contact end 53 and opposed ears 55 disposed between end 53 and retainer 47. To obtain electrical engagement between short circuit strip 26 and heater strip 46, bullet retainer 47 with bullet 38 projecting therethrough, and heater strip 46 are disposed in fusing alloy 44 adjacent the bullet 38-flange 36 interface of spring trigger assembly 28. As bullet 38 is comprised of metal, an electrical circuit is created from heater strip 46, through fusing alloy 44 and bullet 38, and into lead 43. Paper cap 50, having cylindrical body 52 surrounding the outer circumference of barrel 34 and integral end cover 54 disposed over the open end of barrel 34 opposite bullet 38, seals the interior of barrel 34 from the remainder of the area inside the tube 14. Cap 50 may be manufactured from various materials, including wood, plastic, kraft paper, vulcanized fiber or other insulative materials. As cap 50 is not placed upon the end of the trigger 28 until after the soldering of the short circuit strip 26 and heater strip 46 to the bullet 38 is accomplished, materials which would melt in the presence of soldering temperatures may be employed in the sleeve 50.

Heater strip 46 is disposed over cap 50 such that bullet 38 is received through bullet retainer 47 and opposed flaps are wrapped over the circumferential body 52 of cap 50. The positioning of ends 53 over end cover 54 places ends 53 in place to engage interior flat end surface 24 of ferrule 22. Ends 53 are folded over end cover 54, and ears 55 are disposed outward therefrom to lie tangentially to the outer circumferential body 52 to engage the inner surface of tube 14 and position trigger 28 in tube 14. Although in the preferred embodiment it is contemplated that the ears 55 lie tangential to the body 52, ears 55 may be bent to lie normal to body 52 or any angle therebetween.

To minimize arcing after the short circuit strip 26 melts in the insulative tube 14, arc quenching fillers are employed within tube 14 adjacent the fusing components. A solid matrix filler 58, fabricated from sand, sodium silicate (water glass) and distilled water in a wet stoning process is packed about the short circuit strip 26 and located in locating sleeve 65 bounded by washers 62 and 64. A loose sand 60 is packed around trigger assembly 28. Washer 62 includes a slot 66 therein, through which a lead 43 from the end of short circuit strip 26 protrudes to contact the end of bullet 38. Washer 64 likewise includes slot 66 therethrough, through which the opposite end of fusing strip protrudes for engagement with ferrule 22.

Washer 62 and washer 64 bound the area of the porous hard media 58. The short circuit strip 26, surrounded by the porous hard media 58, locating sleeve 65 and washers 62 and 64, may be prepared prior to assembly of fuse 10 as a separate subassembly and later assembled with trigger assembly 28 to create fuse 10.

Although it is believed that other wet stoning processes may be used, the present invention is assembled by first locating washer 62, with short circuit strip 26 threaded through slot 66 therein, in the end of sleeve 65. Short circuit strip 26 includes a locating shoulder 67 which interferes with washer 62 to limit the projection of short circuit strip 26 therethrough. The sleeve 65 is then filled with sand, and washer 64, with short circuit strip 26 threaded therethrough, is located in the opposite end of sleeve 65. The assembly is then placed in a vacuum chamber to allow any gasses present to escape the sand. The assembly, still under a vacuum, is then immersed in a waterglass mixture, comprised of Ninety percent by volume sodium silicate and ten percent by volume distilled water for five to ten minutes. During the immersion process, the vacuum is slowly released in steps, and the assemblies are then pressurized to twenty p.s.i. for several minutes. It has been found that adequate fuse performance may be obtained by an initial vacuum of twenty seven inches of mercury for five minutes, and an immersion period of four minutes in the vacuum followed by an elevated pressure period of two minutes. The assemblies are then centrifuged to drive off excess water glass, and the assemblies are the baked at 110 degrees centigrade for approximately eleven hours to form a puck. It has been found that a solid matrix filler 58 made by the wet stoning process, when combined with a silver short circuit strip 26, will allow fuse 10 to pass the Underwriters Laboratories Class J specification for fuses. It is believed that the porosity of the material permits the arc products of short circuit strip 26, created by the catastrophic failure in one of the narrow current strips 22, to diffuse into the solid matrix filler 58 which aids in arc quenching.

Refering to FIG. 1, to obtain an electrical connection between end cap 20 and heater strip 46, the end 53 of heater strip is folded over the top 54 of cap 50 and ferrule 20 is located over the end of tube 18 and the assembly heated. This heating causes the solder coating 25 to reflow. The heat is removed, and the solder hardens and end 53 and end cap 20 are electrically and mechanically interconnected. Likewise, the end of short circuit strip 26 and ferrule 22 are electrically interconnected in solder coating 25 on the inner surface of ferrule 22. The use of ears 55 on short circuit strip 46 creates an interference between the trigger 28 and the inner wall of tube 14, which centers trigger 28 in tube 14 and helps maintain the ends 53 of heater strip 46 in engagement with the inside of end cap 24 to help assure a good solder connection 25 therebetween.

Referring to FIG. 3, fuse 10 is shown in the open position following a long term overload condition. Trigger 28 has opened in response to the long-term overload condition. The long term overload causes the heater strip 46 to generate heat, which raises the fusing alloy 44 to its melting temperature thereby melting the interface between the short circuit strip 26 and bullet 38, between bullet 38 and flange 36 and between heater strip 46 and bullet 38, causing spring 42 to actuate bullet 38 within barrel 34 from short circuit strip 26 to open the circuit between ferrules 20 and 22.

I claim:

1. A fuse comprising;

an insulating tube having opposed first and second ends;

electrically conductive ferrules disposed on said first and second ends;

a short circuit strip extending from said first end in conductive engagement with said ferrule thereon inward said tube through a solid matrix filler;

a timer fuse assembly disposed adjacent said second end, having a spring loaded bullet disposed within and projecting outward from one end of an open ended barrel assembly;

an insulative cap member mounted on said barrel sealing the end thereof opposite said bullet; and a planar heater strip in conductive engagement with said ferrule covering said second open end and extending therefrom;

said bullet, short circuit strip and heater strip mechanically and electrically interconnected in a fusing alloy.

2. The fuse of claim 1 wherein said bullet includes a spring retainer flange disposed radially about one of its ends within said barrel;

said barrel includes a lip projecting inward at its open end opposite said ferrule a spring disposed between said flange and said lip.

3. The fuse of claim 1 wherein said cap member is manufactured from plastic.

4. The fuse of claim 1 wherein said cap is manufactured of paper.

5. The fuse of claim 1 wherein said cap is manufactured of vulcanized fiber.

6. The fuse of claim 1 wherein said cap is manufactured of kraft paper.

7. The fuse of claim 1 wherein said heater strip includes locating ears projecting radially therefrom.

8. The fuse of claim 1 wherein said timer assembly is disposed in arc quenching silicates.

9. The fuse of claim 8 wherein said arc quenching silicates arc loose sand.

10. The fuse of claim 1 wherein said ferrule on said first end includes a flat surface covering said first end and the short circuit strip interconnects with said ferrule between said insulative cap and said flat end of said ferrule.

11. The fuse of claim 1, wherein the short circuit strip is silver.

12. The fuse of claim 1 wherein said short circuit strip includes ears projecting therefrom tangential to the outer circumference of said insulative cap.

13. The fuse of claim 1 wherein said heater strip includes ears to locate said timer assembly in said tube.

14. The fuse of claim 1, wherein said planar fuse strip includes a first flap and a second flap interconnected by a bullet retainer portion, said first flap and said second flap disposed on said barrel, and extending from said open end of said barrel assembly to said ferrule covering said second open end.

15. The fuse of claim 14, wherein said first flap and said second flap include locating ears projecting therefrom.

16. The fuse of claim 14 wherein the short circuit strip interconnects with said second ferrule between the insulative cap and the flat end of the ferrule.

17. The fuse of claim 14, wherein the short circuit strip is silver.

18. The fuse of claim 14 wherein said short circuit strip includes ears projecting therefrom tangential to the outer circumference of said insulative cap.

19. The fuse of claim 14 wherein said heater strip includes ears to locate said timer assembly in said tube.

20. A fuse, comprising, a tubular insulative body having first and second ends;

a short circuit strip disposed in said body and having a ferrule end and a bullet end;

a first ferrule disposed on said body first end and in conductive engagement with said ferrule end;

a barrel having a barrel orifice therein received within said second end;

a bullet member disposed within said barrel and partially projecting therefrom through said barrel orifice inward said tubular body;

a second ferrule disposed on said second end over said barrel;

a heater strip having a flat profile disposed on said barrel including a flap portion extending from said bullet orifice, said flap portion including a locating tab projecting therefrom into engagement with the inner diameter of said tubular body.

21. The fuse of claim 20, wherein said heater strip includes a bullet retainer portion disposed about said bullet adjacent said barrel.

* * * * *